US007320467B2

(12) United States Patent
Matilla et al.

(10) Patent No.: US 7,320,467 B2
(45) Date of Patent: Jan. 22, 2008

(54) NARRATING GAMES

(75) Inventors: Kimberly V. Matilla, Venice, CA (US); Benjamin Blagg, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 33 days.

(21) Appl. No.: 11/406,736

(22) Filed: Apr. 18, 2006

(65) Prior Publication Data

US 2007/0007725 A1 Jan. 11, 2007

Related U.S. Application Data

(60) Provisional application No. 60/687,203, filed on Jun. 3, 2005.

(51) Int. Cl.
*A63F 1/00* (2006.01)

(52) U.S. Cl. ..... 273/292; 273/273

(58) Field of Classification Search ..... 273/292, 273/273, 156, 157 R, 300, 308; 434/167, 434/171, 1

See application file for complete search history.

(56) References Cited

U.S. PATENT DOCUMENTS

| | | | | |
|---|---|---|---|---|
| 1,716,069 | A | 6/1929 | Loayza | |
| 2,521,775 | A | 9/1950 | Brower | |
| 2,728,997 | A | 1/1956 | Gross | |
| 3,891,209 | A | 6/1975 | Kritzberg | |
| 3,940,863 | A | 3/1976 | Kritzberg | |
| 4,216,594 | A * | 8/1980 | Farley et al. | 434/236 |
| 4,637,799 | A * | 1/1987 | Bouchal | 434/236 |
| 4,684,135 | A * | 8/1987 | Bouchal | 273/269 |
| 4,966,372 | A | 10/1990 | Robison | |
| 5,005,839 | A | 4/1991 | Ryan et al. | |
| 5,100,154 | A | 3/1992 | Mullins | |
| 5,282,632 | A | 2/1994 | Allen et al. | |
| 5,435,726 | A | 7/1995 | Taylor | |
| 5,540,609 | A | 7/1996 | Hoag | |
| 5,657,992 | A | 8/1997 | Bellizzi | |
| 6,139,016 | A * | 10/2000 | Plato | 273/242 |
| 6,270,077 | B1 | 8/2001 | Cohen | |
| 6,474,650 | B1 * | 11/2002 | Looney | 273/308 |
| 6,638,171 | B1 | 10/2003 | Igarashi et al. | |

(Continued)

FOREIGN PATENT DOCUMENTS

EP 0645721 8/1994

(Continued)

*Primary Examiner*—William M. Pierce
(74) *Attorney, Agent, or Firm*—Kolisch Hartwell, et al.

(57) ABSTRACT

The present disclosure is directed to narrating games and methods of playing narrating games. In some embodiments, the game includes a plurality of playing cards and a plurality of game boards. In some embodiments, the method includes selecting a first playing piece; telling a first part of a story; selecting a second playing piece; telling a second part of the story; hiding at least one indicium of the first and second playing pieces; and recalling the at least one hidden indicium of at least one of the first and second playing pieces. In some embodiments, the method includes a first player selecting a first playing piece; the first playing telling a first part of a story; a second player selecting a second playing piece; the second player retelling the first part of the story; and the second player telling a second part of the story.

29 Claims, 4 Drawing Sheets

U.S. PATENT DOCUMENTS

| | | | | |
|---|---|---|---|---|
| 6,786,729 | B2 * | 9/2004 | Lee | 434/159 |
| 7,018,210 | B2 * | 3/2006 | Goldman et al. | 434/172 |
| 2002/0074727 | A1 | 6/2002 | Glaser | |
| 2004/0026857 | A1 | 2/2004 | O'Connell | |
| 2004/0084841 | A1 | 5/2004 | Murrell | |
| 2004/0178577 | A1 | 9/2004 | Kline et al. | |
| 2005/0001377 | A1 | 1/2005 | Bradley | |
| 2005/0093239 | A1 | 5/2005 | Johnston | |
| 2005/0167920 | A1 | 8/2005 | Rose et al. | |

FOREIGN PATENT DOCUMENTS

| | | |
|---|---|---|
| GB | 2210271 | 6/1989 |
| JP | 8289974 | 11/1996 |
| JP | 2002282533 | 10/2002 |

* cited by examiner

NARRATING GAMES

CROSS-REFERENCE TO RELATED APPLICATIONS

This application claims priority under 35 U.S.C. § 119(e) to U.S. Provisional Patent Application Ser. No. 60/687,203 entitled "Narrating Games," filed Jun. 3, 2005. The complete disclosure of that application is hereby incorporated by reference for all purposes.

BACKGROUND OF THE DISCLOSURE

The present disclosure is directed to narrating and/or story-telling games, including those games where play may be facilitated by one or more playing pieces.

Examples of narrating and/or story-telling games are found in U.S. Pat. Nos. 6,638,171; 6,270,077; 5,540,609; 5,435,726; 5,282,632; 5,100,154; 5,005,839; 4,684,135; 4,637,799; 3,940,863; 3,891,209; 2,728,997; 2,521,775; and 1,716,069; U.S. Patent Application Publication Nos. 2005/0093239; 2004/0026857; and 2002/0074727; United Kingdom Patent Application No. GB-A 2210271; and Japanese Patent Application Nos. 8289974 and 2002-282533. The complete disclosures of those patents and patent applications are herein incorporated by reference for all purposes.

SUMMARY OF THE DISCLOSURE

Some embodiments provide a method of playing a game. The game including a plurality of playing pieces, at least some of the playing pieces each has at least one indicium that is representative of a concept. The method comprising selecting a first playing piece; telling a first part of a story, the first part being associated with the concept represented by the at least one indicium of the selected first playing piece; selecting a second playing piece; telling a second part of the story, the second part being associated with the concept represented by the at least one indicium of the selected second playing piece; hiding the at least one indicium of the first and second playing pieces; and recalling the at least one hidden indicium of at least one of the first and second playing pieces.

Some embodiments provide a method of playing a game. The game including at least one game board and a plurality of playing cards, at least some of the playing cards each has at least one graphic image that is representative of a concept and at least one play indicium. The method comprising selecting a first playing card; placing the first playing card on the at least one game board with the at least one graphic image and the at least one play indicium of the first playing card visible; telling a first part of a story, the first part being associated with the concept represented by the at least one graphic image of the placed first playing card; selecting a second playing card, the second playing card including the at least one play indicium that corresponds with the at least one play indicium of the placed first playing card; placing the second playing card on the at least one game board with the at least one graphic image and the at least one play indicium of the second playing card visible; retelling the first part of the story; after retelling the first part of the story, telling a second part of the story, the second part being associated with the concept represented by the at least one graphic image of the second playing card; hiding the at least one graphic image of the first and second playing cards after telling the second part of the story; recalling the at least one hidden graphic image of at least one of the first and second playing cards; and revealing the at least one graphic image of at least one of the first and second playing cards to determine if the at least one graphic image was correctly recalled.

Some embodiments provide a method of playing a game for at least two players including a first player and a second player. The game including a plurality of playing pieces, at least some of the playing pieces each has at least one concept indicium that is representative of a concept and at least one play indicium. The method comprising the first player selecting a first playing piece; the first player telling a first part of a story, the first part being associated with the concept represented by the at least one concept indicium of the first playing piece; the second player selecting a second playing piece having the at least one play indicium that corresponds with the at least one play indicium of the first playing piece; the second player retelling the first part of the story; and the second player, after retelling the first part of the story, telling a second part of the story, the second part being associated with the concept represented by the at least one concept indicium of the second playing piece.

Some embodiments provide a game. The game comprising a plurality of playing cards, at least some of the playing cards each including at least one graphic image; and a plurality of game boards each including a plurality of card receiving spaces, the plurality of game boards being configured to interlock to form a combination game board having a number of card receiving spaces equal to a sum of card receiving spaces of the individual interlocked boards.

DETAILED DESCRIPTION OF THE DISCLOSURE

Figure 1:
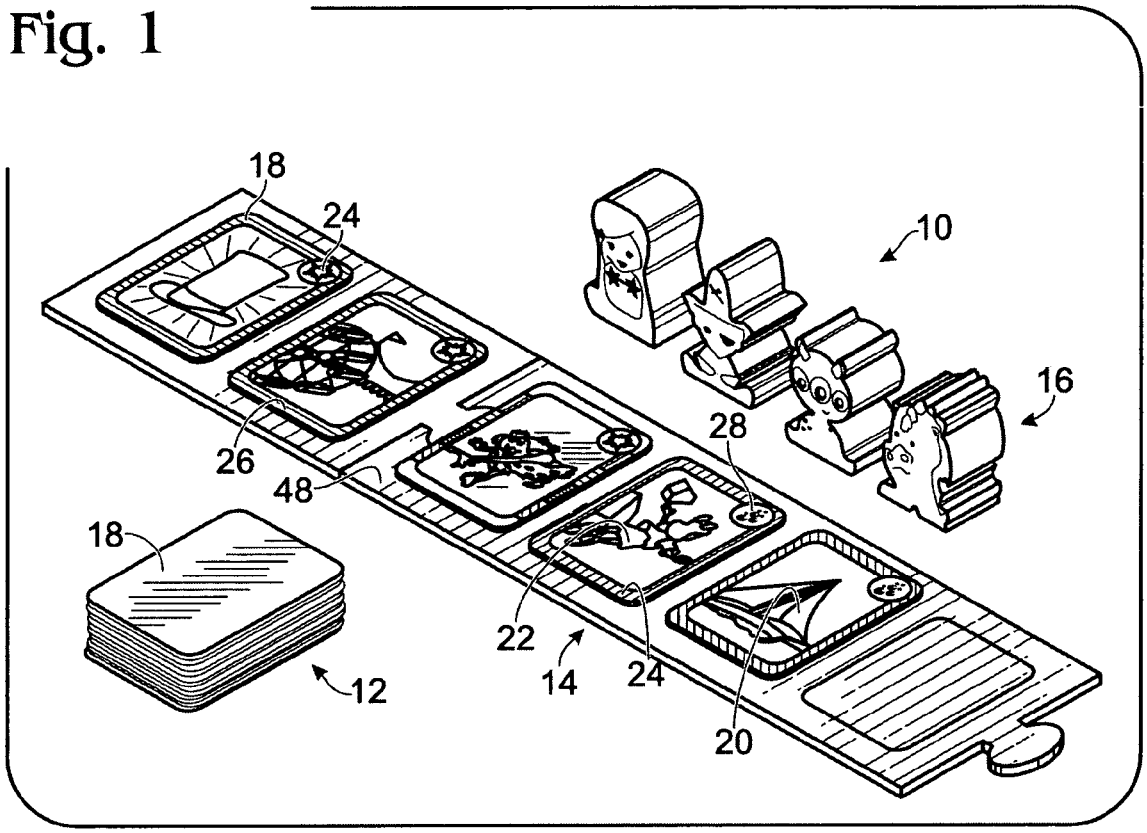
FIG. 1 shows some embodiments of a narrating game.

Referring to FIG. 1, some embodiments of a narrating game is shown generally at 10 and may include a plurality of playing pieces 12, a playing area 14, and a plurality of character pieces 16.

Playing pieces 12 may include any suitable structure configured to facilitate the narrating game. For example, the playing pieces may include a plurality of playing cards 18. The playing cards may be any suitable size and/or shape configured to allow players of the game to grasp the playing cards and/or position those cards on the playing area. Additionally, the playing cards may be any suitable number, such as fifty-two cards. Moreover, playing cards may have gripping features (not shown) to improve contact with players' fingers. Those gripping features may include grooves, ridges, undulations, and/or rough portions, among others, or any suitable combination to promote handling.

Figure 2:
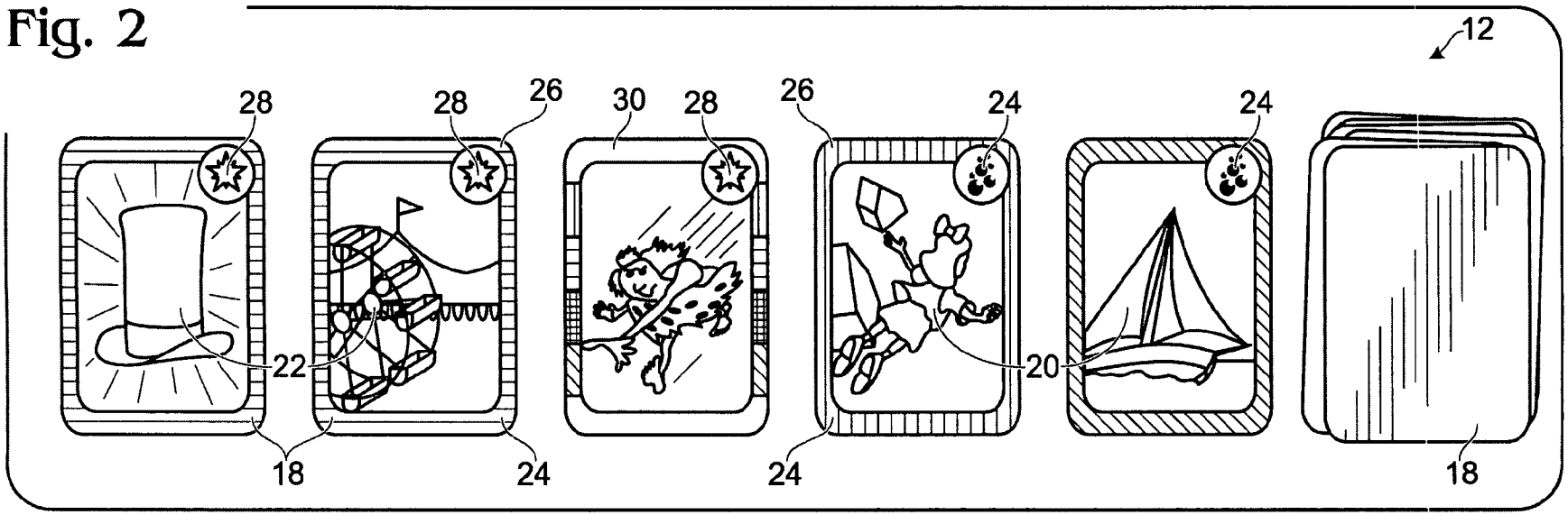
FIG. 2 shows playing pieces for the narrating game of FIG. 1.

At least some of the playing cards each may include one or more concept indicia 20. The concept indicia may include any suitable type(s) of indicia configured to represent one or more concepts. For example, concept indicia 20 may include object representations and/or graphic images 22. The graphic images and/or object representations may include one or more objects, characters, places, actions, etc. For example, as shown in FIG. 2, graphic images 22 may include images of a caveman, a hat, a ferris wheel, a flying girl, a sailboat, etc.

Although specific images are shown, graphic images 22 may include any images of any suitable objects, characters, places, actions, etc. Additionally, although only one graphic image is shown on each of the playing cards, any suitable number of graphic images may be included for the playing cards. Moreover, although concept indicia 20 are shown to include graphic images 22, the concept indicia may alternatively, or additionally, include number(s), text, alphanumeric character(s), geometric shape(s), symbol(s), color(s), and/or any suitable combination.

At least some of the playing cards may include one or more play indicia 24. The play indicia may be different types with each type of the play indicium appearing on one or more of the at least some of the playing cards. The play indicia may include any suitable type(s) of indicia on the playing cards configured to correspond to and/or at least substantially match the play indicia on other playing cards and/or to convey any suitable information to the players. For example, play indicia 24 may include color indicia 26 and/or iconic indicia 28, as shown in FIG. 2.

"Correspond," "corresponds," and "corresponding," as used herein, means that there are one or more characteristics in common between the indicia. Although play indicia 24 is shown to include color indicia 26 and/or iconic indicia 28, the play indicia may alternatively, or additionally, include numeral(s), text, alphanumeric character(s), symbol(s), geometric shape(s), and/or any suitable combination. For example, the play indicia on the playing cards may include text indicia, which may correspond to text indicia on other playing cards.

Additionally, one or more of the playing cards may include multiple color and/or iconic indicia, which may correspond to multiple indicia on other of the playing cards. Alternatively, or additionally, one or more of the playing cards may be designated in any suitable way as "wild" cards that may be played as if it contained some or all of play indicia 24, such as wild playing card 30 shown in FIG. 2, which may include at least some of the types of color indicia used on the other playing cards.

Moreover, although color indicia 26 are shown to be shaped as an outer perimeter or border of the playing cards, the color indicia may have any suitable shape(s) and/or location(s). Furthermore, although iconic indicia 28 are shown to be located on the upper right corner of the playing cards, the iconic indicia may be located in any suitable portion of the playing cards. Additionally, although playing pieces 12 are shown to include playing cards 18, any suitable two or three-dimensional objects may be used that may have the concept and play indicia discussed above and/or may be received on the playing area. For example, playing pieces 12 may include tokens, coins, sculptures, etc.

Figure 3:
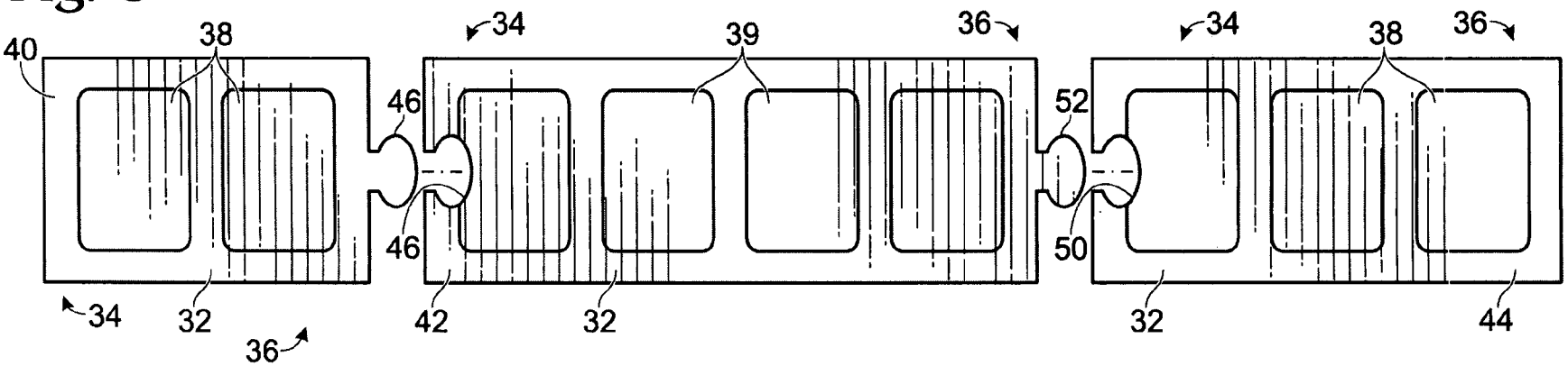
FIG. 3 shows a playing area including a plurality of game boards for the narrating game of FIG. 1.

Playing area 14 may include any suitable structure to receive at least some of the playing pieces and/or at least some of the character pieces. For example, playing area may be in the form of one or more game boards 32, as shown in FIGS. 1 and 3. At least some of the game boards may include a first end portion 34 and a second end portion 36. Additionally, at least some of the game boards may each include a plurality of playing piece receiving spaces 38 (such as card receiving spaces).

The playing piece receiving spaces may include any suitable spaces configured to receive at least some of playing pieces. Playing piece receiving spaces 38 may, for example, include a plurality of rectangles 39. The playing card receiving spaces may be sized to receive one or more of the playing pieces.

The playing piece receiving spaces also may be distributed along game boards 32 in any suitable fashion. For example, playing piece receiving spaces 38 may be distributed across at least a substantial portion of the playing area in a linear fashion, as shown in FIGS. 1 and 3. Additionally, any suitable number of playing piece receiving spaces 38 may be provided on game boards 32. The number of playing piece receiving spaces on at least some of the game boards may be the same or may be different. For example, FIG. 3 shows a first game board 40 with two playing piece receiving spaces 38, a second game board 42 with four playing piece receiving spaces, and a third game board 44 with three playing piece receiving spaces. Alternatively, each game board may include a certain number of playing piece receiving spaces 38, such as three or four spaces.

Although playing piece receiving spaces 38 are shown to include rectangles 39, those spaces may include any suitable shape(s) or form(s), including squares, triangles, circles, and/or any suitable combination. Additionally, although each of the playing piece receiving spaces is shown to be sized to fit one of the playing pieces, those spaces may be sized for any suitable number of the playing pieces, including two playing pieces, three playing pieces, four playing pieces, etc. Moreover, although playing piece receiving spaces 38 are shown in FIGS. 1 and 3 to be distributed across a substantial portion of game boards 32 in a linear fashion, those spaces may be distributed in any patterned and/or random way across any suitable portion(s) of the game board(s). Furthermore, although game boards 32 are shown to include two to four playing piece receiving spaces 38, the game boards may include any suitable number of the playing piece receiving spaces.

At least some of game boards 32 may include one or more interlocking structures 40, which may include any suitable structure configured to interlock to form at least one combination game board 42 having a number of playing piece receiving spaces equal to a sum of playing piece receiving spaces of the individual interlocked game boards. For example, interlocking structures 40 may include at least one receiving portion 44 and/or at least one protruding portion 46, as shown in FIG. 3. The receiving portion may be configured to receive at least one protruding portion. The interlocking structure(s) may be located on any suitable portion(s) of the game boards. For example, at least some of game boards 32 may include receiving and/or protruding portions on the first end portion and/or receiving and/or protruding portions on the second end portion.

Although interlocking structures 40 are shown to be located on one or more end portions of the game boards, the interlocking structures may be located on any suitable portion(s) of the game boards, such as one or more side portions. Additionally, although the combination game board in FIG. 3 is shown to include game boards 32 with specific types of interlocking structures 40, the game boards may include any suitable type(s) of the interlocking structures. For example, at least some of the game boards may include both the receiving and protruding portions to allow a user to interlock more than three game boards. Alternatively, or additionally, at least some of the game boards may be free from interlocking structures and the user may simply place those game boards adjacent to each other. Moreover, although interlocking structures 40 are shown to include the receiving and protruding portions, the interlocking structures may include any suitable structure configured to allow two or more game boards to interlock to form the combination game board.

In some embodiments, the game boards may include one or more board indicia (not shown), which may include any suitable indicia configured to facilitate game play. For example, the board indicia may include text requiring a specific theme and/or specific time span for the story. Additionally, or alternatively, the board indicia may correspond to, or at least substantially match, the play indicia on the playing cards.

Although playing area 14 is shown to include game boards 32, the playing area may include any suitable structure configured to receive at least some of the playing pieces, such as mats, restaurant menus, sculptures of suitable items, etc. Alternatively, the playing area may simply be any surface, such as a desk or a floor.

Figure 4:
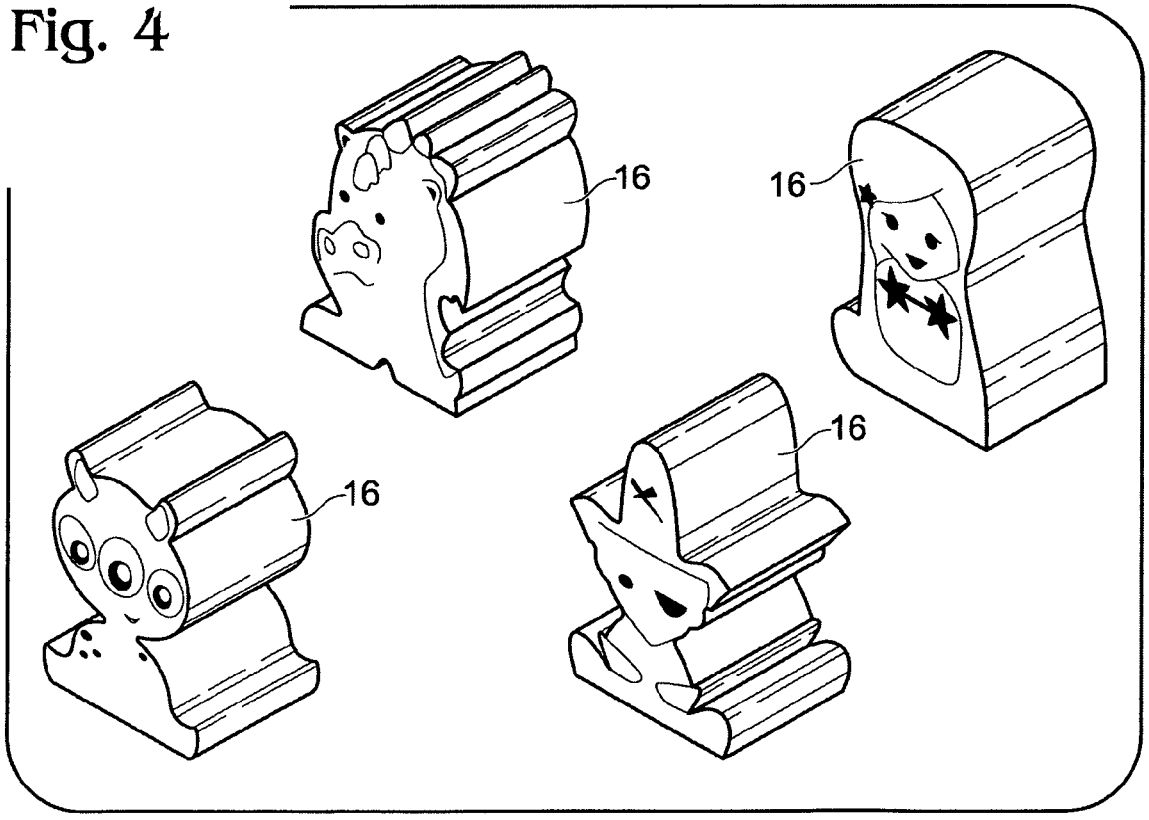
FIG. 4 shows character pieces for the narrating game of FIG. 1.

Character pieces 16, as shown in FIG. 4, may include any suitable structure configured to represent one or more characters. The character pieces may be any suitable size and/or shape configured to allow players of the game to grasp the character piece. Additionally, the character pieces may be any suitable number, such as the number of maximum players per game.

Moreover, character pieces 16 may have gripping features (not shown) to improve contact with a player's fingers. Those gripping features may include grooves, ridges, undulations, and/or rough portions, among others, or any suitable combination to promote handling. Although character pieces 16 are shown to represent particular characters, the character pieces may represent any suitable character(s). Additionally, although four character pieces 16 are shown, any suitable number of the character pieces may be included with game 10.

In some embodiments of the game, the character pieces may include indicia (not shown) that corresponds to or at least substantially matches the play indicia of the playing cards. For example, the character pieces may have color indicia and iconic indicia that correspond to the color and iconic indicia of the playing cards.

Although game 10 is shown to include playing pieces 12, playing area 14, and character pieces 16, the game may include any suitable structure configured to provide narrating and/or story-telling games. For example, the game may include only playing pieces 12. Alternatively, or additionally, the game may include other structure configured to facilitate the narrating game.

Figure 5:
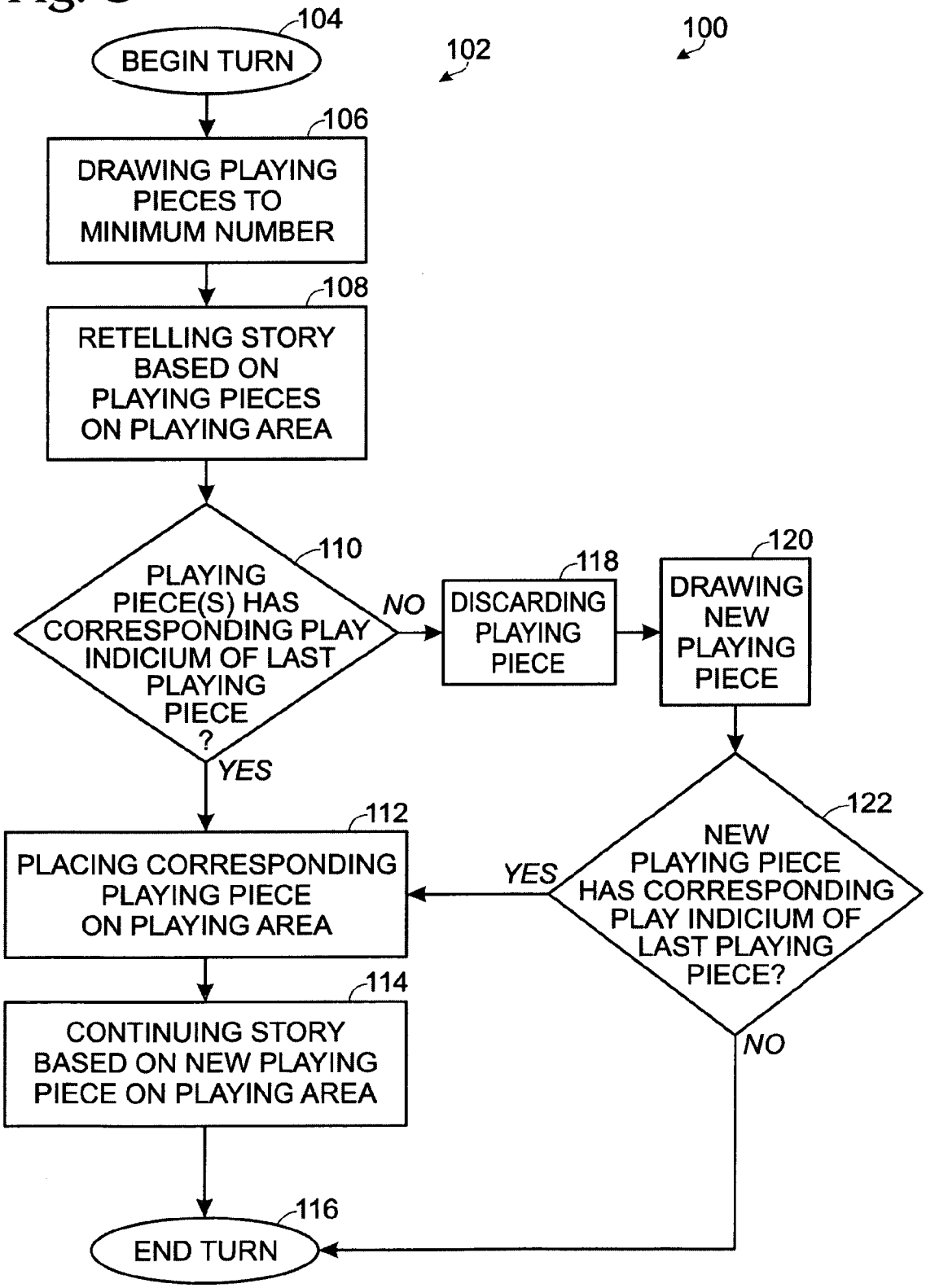
FIGS. 5-6 show flowcharts showing some embodiments of a method of playing the game of FIG. 1.

A method 100 for playing game 10 will be further described with reference to FIGS. 5-6. The method may be divided into any suitable number of phases or rounds. For example, a method of playing a first or story round 102 of the game is shown in FIG. 5. A player may begin his or her turn at 104. That player may draw the playing pieces (such as playing cards) from a stack so that he or she has a minimum number, such as three cards, at 106. The player may then repeat the parts of the story based on and/or associated with the concept represented by the concept indicia (such as graphic images, which may include one or more images of objects, characters, places, and actions) on the playing pieces already on the playing area at 108. If the player is first to start the round, then that player may skip this step.

The player may check if any of the drawn playing pieces has corresponding play indicia (such as color and/or iconic indicia) with the playing pieces previously placed on the playing area at 110. If one or more playing pieces have corresponding play indicia, then the player may select one of those playing pieces and place it on the playing area with the concept and play indicia visible at 112. The player may then continue with a new part of the story based on and/or being associated with the concept represented by the at least one concept indicium of the selected playing piece on the playing area at 114. That player's turn may then end at 116.

If none of the drawn playing pieces has corresponding play indicia, then the player may discard one playing piece at 118 and may draw a new playing piece at 120. The player may check if the new playing piece has corresponding play indicia with the playing piece previously placed on the playing area at 122. If the new playing piece does not have corresponding play indicia, then the player's turn may end at 116.

If the new playing piece has corresponding play indicia, then the player may place that playing piece on the playing area at 112. The player may then continue with a new part of the story based on and/or associated with the concept represented by the concept indicium of the new playing piece on the playing area at 114. That player's turn may then end at 116.

If the player is the first player, then that player may skip at least some of the steps discussed above and may place any of the drawn playing pieces on any suitable location on the playing area. For example, the first player may select a playing piece and then place the playing piece on the leftmost playing piece receiving space. The first player may then tell a first part of the story based on or associated with the concept indicium of the playing piece placed on the playing area. The second player may then follow the method described above.

Players may take turns going through the method of first round 102 and the goal is to play until any suitable stopping point. For example, the round may be played until all the playing pieces receiving spaces on the playing area (which may include one or more of the game boards) are full. Alternatively, or additionally, the round may be played until any suitable number of playing pieces have been played or placed on the playing area. Although particular stopping points have been discussed, the method includes all suitable stopping points for the round, which may include all, some, or none of the stopping points discussed above.

Additionally, the method may include any suitable preparation steps before beginning the round and/or the game. For example, at least some of the playing pieces may be mixed and/or shuffled and any suitable number of playing pieces (such as three) may be given and/or dealt to each player. Moreover, an order of play may be determined before the round and/or game. The order of play may be based on any suitable order, such as by descending or ascending age of the players. Furthermore, the number and/or types of the game boards to be used during the game may be determined and/or selected. That number may be based, at least in part, on any suitable factor or combination of factors, such as number of players, length of play desired, etc. Additionally, the players may select their character pieces from the plurality of character pieces before beginning the round and/or the game.

Furthermore, the method may be modified to increase or decrease its challenge, or for any suitable purpose. For example, at least some of the players may be required to retell the story in reverse or random order. Additionally, or alternatively, at least some of the players may be required to associate their part of the story with the characters represented by their character pieces in addition to, or as an alternative to, associating that part with the selected or new playing pieces.

Alternatively, or additionally, playing pieces may be used even if the play indicia do not match the indicia of the previous playing piece. Additionally, or alternatively, the play indicia of the playing card may be required to correspond to, or at least substantially match, the indicia on the character pieces and/or board indicia associated with the playing piece receiving space adjacent to the last placed playing piece. Alternatively, or additionally, more than one playing piece may be played per turn.

However, the steps discussed above may be performed in different sequences and in different combinations, not all steps being required for all embodiments of the round and/or the game. For example, a player may be required to select a playing piece with corresponding play indicia and place that playing piece on the playing area before retelling the previous parts of the story and telling the new part of the story associated with the concept represented by the concept indicium of the selected playing piece. Additionally, or alternatively, a player may be required to tell the new part of the story first before telling the previous parts of the story.

Figure 6:
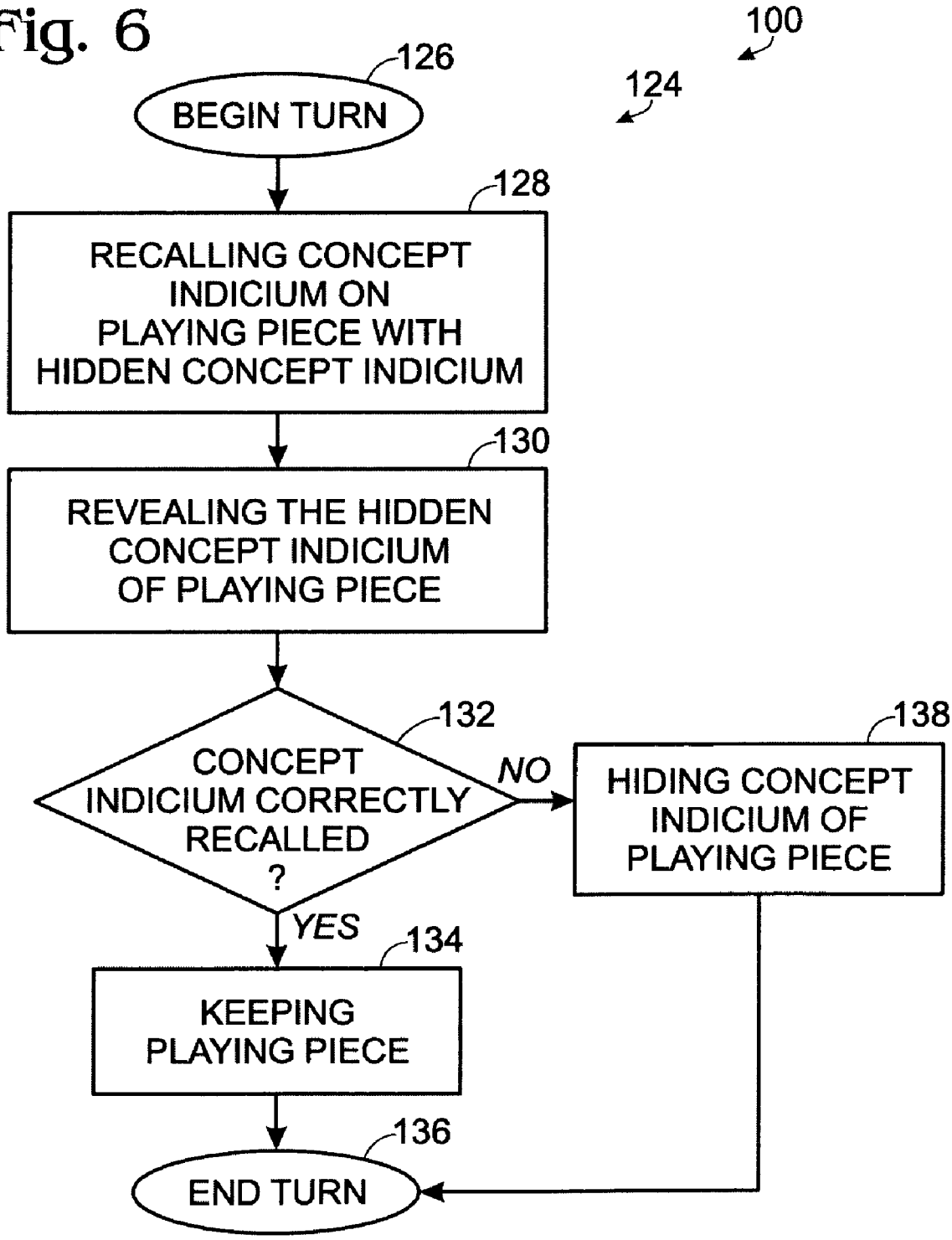

When the stopping point of the method of first round 102 is reached, the players may then proceed to a second or memory round 124 of game 10 as shown in FIG. 6. A player may begin his or her turn at 126. That player may recall the concept indicium of at least one playing piece with hidden concept indicium at 128. The player may then reveal the hidden concept indicium of the playing piece at 130.

That player and/or one or more other players may then determine if the hidden concept indicium was correctly recalled at 132. If the concept indicium was correctly recalled, then the player may keep the playing piece at 134 and may end his or her turn at 136. If the concept indicium was not correctly recalled, then the player may hide the concept indicium of the playing piece at 138 and may end his or her turn at 136.

Players may take turns going through the method and the goal is to play until any suitable stopping point. For example, the round may be played until all the concept indicia of the playing pieces have been revealed. Alternatively, or additionally, the round may be played until a player has a certain number of playing pieces. Although particular stopping points have been discussed, the method includes all suitable stopping points for the round, which may include all, some, or none of the stopping points discussed above.

Additionally, the method may include any suitable preparation steps before beginning the round. For example, the concept indicia of at least some of the playing cards may be hidden, such as turning playing pieces over face down on the playing area. Moreover, an order of play may be determined before the round. The order of play may be based on any suitable order, such as the player who played the last card in the previous round will go second in the round.

Furthermore, the method may be modified to increase or decrease its challenge, and/or for any suitable purpose. For example, the order of any suitable number of playing pieces may be switched by any suitable player after the concept indicia of those cards have been hidden and/or before the concept indicium is recalled, such as the player who played the last playing piece in the first round may switch the placement of two playing pieces on the playing area, thereby providing extra challenges. However, the steps discussed above may be performed in different sequences and in different combinations, not all steps being required for all embodiments of the round and/or the game.

The players may go through the methods described above any suitable number of times as they create and/or recount any suitable number of stories. For example, the players may go through the first and second rounds three times. The winner of the game may be determined in any suitable way. For example, the player with the most playing pieces at the end of the game may be the winner. Alternatively, or additionally, the player with the most points at the end of the game may be the winner. The player's score may be calculated by any suitable method and may be based, at least in part, on any suitable indicia of the components of the game. For example, any suitable number of points may be awarded for being able to recount the concept indicia of the playing piece(s). Although particular bases of calculating the score is discussed, the method includes all other suitable bases of calculating the score, which may include all, some, or none of the bases described above.

Although play of the game is described as having first and second rounds, the game may include any suitable rounds and any suitable combination of rounds. For example, the game may include a third round where players play the same playing pieces as they did in the first round but must narrate a different story, and/or a fourth round where players must recall the concept indicia using the same playing pieces.

The game also may include a set of instructions or rules and/or an inventory of contents. An example of instructions, rules, and inventory that might be used for the game is provided below. Although a specific example is provided, the game may include a set of any suitable instructions, rules and/or inventory, including any suitable combination of the instructions, rules, and inventory already discussed above.

General Description:

It's so much fun to make up stories! In this game you get to create silly stories with your opponent by playing cards one at a time. Use the colorful pictures on the cards to direct your story and watch how funny they become. In order to win, however, you must be the player who can remember the most cards, in order, after they are flipped over! It's the perfect balance of concentration and creativity!

For 2-4 players

Creative Storytelling

Concentration

Contents:

52 Story Cards

3 Story Boards

4 Character "Story Starters"

The Object

To win, be the player that can remember the most cards during the memory round.

Pick a story starter character out of the bag and create a story with your opponent's one card at a time. But to win you must be victorious in the Memory Round when all the cards are turned over after the story has been completed. Take turns recalling the face down cards, in order, flipping them over one at a time. If you guess correctly you get to keep the card. The player who correctly remembers the most cards wins.

Let's Play!

1. Place all 4 Story Starters in the bag.
2. The first player to yell out their most favorite story gets to pick the "story starter" out of the bag.

3. Choose the length of your game by laying out the appropriate sized board, or by linking two or three boards together. (1 board w/4 spaces/1 board w/2 spaces/1 board w/3 spaces.)
4. Shuffle the 52 story cards and deal 3 to each player.
5. Youngest player goes first.

The Story Starters:

These 4 characters want to be part of your imaginative tale. Use them to help your story along. They can be main characters, or just funny sidekicks. It's up to you! Look for their icons as you play each story card. At the end of the memory round, if there is a tie, the player whose cards have the most icons matching the Story Starter in play will win the game!

Story Round

1. The first player may choose any card in their hand and play it face up on the board starting on the furthest left space. As you lay it down, begin a story by including the object on the card. If you wish also include the story starter in play. Draw back up to three at the beginning of every turn.
2. Player 2 repeats the previous story. Then he/she plays their card continuing the tale based on the object on that card. Player 2 may only play a card that matches the same color or icon as the previous card played.
3. If a player has no matches in their hand you have once chance to make a new match. Discard 1 of your cards and draw a new one in its place. Play the card if it is a match. If it is not, your turn is over.
4. Players continue taking turns repeating the story and playing a new card to continue the story until the board is full.
5. When the storyboard has been completely filled, the Story Round is officially over, and the Memory Round begins.

Memory Round

1. The player who places the final card to fill up the storyboard flips all the cards over one at a time so that they are all face down.
2. Turn order continues uninterrupted so that the next player is the first one to guess.
3. Begin the memory round by the guessing at the first card played in the story and continuing in order.
4. Take turns remembering which object, character, place or action is on the face down cards, one at a time.
5. Make your guess out loud, and then turn over the card to check if you are correct.
   a. If you guess correctly take the card and place it in front of you. Each card counts as 1 point and will remain in front of you till the end of the game.
   b. If you guess incorrectly return the card face down to its place on the story board for the next player to guess. Players take turns guessing until all the cards have been removed from the story board.
6. The player with the most cards in front of them after the memory round wins the game.
7. If there is a tie, the player whose cards have the most icons matching the Story Starter in play will win the game!

Level 2

1. When the Story Round if over and the board is full, flip all the cards face down.
2. The player who played the last card may now switch the placement of any two cards on the Story Board. This will create any extra challenge during the Memory Round.
3. To insure victory, players may choose cards to remember out of order to insure they have the most cards with icons matching the story starter in play.

Winning the Game

To win, be the player that can remember the most cards during the memory round.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A method of playing a game, the game including a plurality of playing pieces, at least some of the playing pieces each has at least one indicium that is representative of a concept, comprising:

selecting a first playing piece;

telling a first part of a story, the first part being associated with the concept represented by the at least one indicium of the selected first playing piece;

selecting a second playing piece;

telling a second part of the story, the second part being associated with the concept represented by the at least one indicium of the selected second playing piece;

hiding the at least one indicium of the first and second playing pieces; and recalling the at least one hidden indicium of at least one of the first and second playing pieces.

2. The method of claim 1, where the at least one indicium of the at least some of the playing pieces each includes at least one graphic image representative of a concept, and wherein telling a first part of a story includes telling a first part of a story with the first part being associated with the concept of the at least one graphic image of the first playing piece.

3. The method of claim 2, where the at least one graphic image includes an image of at least one of an object, a character, a place, and an action, and wherein telling a first part of a story includes telling a first part of a story with the first part being associated with the concept of the at least one of an object, a character, a place, and an action.

4. The method of claim 1, where at least some of the playing pieces each includes at least one play indicium, and wherein selecting a second playing piece includes selecting a second playing piece having the at least one play indicium that corresponds with the at least one play indicium of the first playing piece.

5. The method of claim 4, where the at least one play indicium includes at least one of a color and an icon, and wherein selecting a second playing piece includes selecting a second playing piece that includes at least one of a color and an icon that corresponds with at least one of a color and an icon of the first playing piece.

6. The method of claim 1, where the game further includes one or more game boards, at least some of the game boards each includes a plurality of playing piece receiving spaces, and wherein selecting a first playing piece includes placing the first playing piece on a playing piece receiving space of one of the game boards.

7. The method of claim 6, wherein selecting a second playing piece includes placing the second playing piece on a playing piece receiving space adjacent to the playing piece receiving space of the first playing piece.

8. The method of claim 7, further comprising switching the positions of the placed first and second playing pieces.

9. The method of claim 8, wherein switching the positions of the first and second playing pieces occurs prior to recalling the at least one hidden indicium of at least one of the first and second playing pieces.

10. The method of claim 1, where the game further includes one or more game boards, at least some of the game boards each includes a plurality of playing piece receiving spaces, further comprising selecting a number of game boards to use for the game.

11. The method of claim 1, wherein hiding the at least one indicium occurs after telling the first and second parts of the story.

12. The method of claim 1, further comprising revealing the at least one indicium of at least one of the first and second playing pieces to determine if the at least one indicium was correctly recalled.

13. The method of claim 1, where the game further includes a plurality of character pieces, each character piece being representative of a character, further comprising selecting a character piece from the plurality of character pieces.

14. The method of claim 13, wherein telling a first part of a story includes telling a first part of a story with the first part being associated with the character represented by the selected character piece.

15. The method of claim 14, wherein telling a second part of a story includes telling a second part of a story with the second part being associated with the character represented by the selected character piece.

16. A method of playing a game, the game including at least one game board and a plurality of playing cards, at least some of the playing cards each has at least one graphic image that is representative of a concept and at least one play indicium, comprising:

selecting a first playing card;

placing the first playing card on the at least one game board with the at least one graphic image and the at least one play indicium of the first playing card visible;

telling a first part of a story, the first part being associated with the concept represented by the at least one graphic image of the placed first playing card;

selecting a second playing card, the second playing card including the at least one play indicium that corresponds with the at least one play indicium of the placed first playing card;

placing the second playing card on the at least one game board with the at least one graphic image and the at least one play indicium of the second playing card visible;

retelling the first part of the story;

after retelling the first part of the story, telling a second part of the story, the second part being associated with the concept represented by the at least one graphic image of the second playing card;

hiding the at least one graphic image of the first and second playing cards after telling the second part of the story;

recalling the at least one hidden graphic image of at least one of the first and second playing cards; and revealing the at least one graphic image of at least one of the first and second playing cards to determine if the at least one graphic image was correctly recalled.

17. The method of claim 16, further comprising switching the positions of the first and second playing cards on the at least one game board.

18. The method of claim 16, wherein switching the positions of the first and second playing cards occurs prior to recalling the at least one hidden graphic image of at least one of the first and second playing cards.

19. A method of playing a game for at least two players including a first player and a second player, the game including a plurality of playing pieces, at least some of the playing pieces each has at least one concept indicium that is representative of a concept and at least one play indicium, comprising:

the first player selecting a first playing piece;

the first player telling a first part of a story, the first part being associated with the concept represented by the at least one concept indicium of the first playing piece;

the second player selecting a second playing piece having the at least one play indicium that corresponds with the at least one play indicium of the first playing piece;

the second player retelling the first part of the story; and the second player, after retelling the first part of the story, telling a second part of the story, the second part being associated with the concept represented by the at least one concept indicium of the second playing piece.

20. The method of claim 19, further comprising one of the at least two players hiding the at least one concept indicium of the first and second playing pieces.

21. The method of claim 20, further comprising one of the at least two players recalling the at least one hidden concept indicium of at least one of the first and second playing pieces.

22. The method of claim 20, wherein the step of hiding the at least one concept indicium occurs before the step of recalling the at least one concept indicium.

23. The method of claim 21, further comprising one of the at least two players revealing the at least one concept indicium of at least one of the first and second playing pieces to determine if the at least one concept indicium was correctly recalled.

24. A game, comprising:

a plurality of playing cards, at least some of the playing cards each including at least one graphic image; and a plurality of game boards each including a plurality of card receiving spaces, the plurality of game boards being configured to interlock to form a combination game board having a number of card receiving spaces equal to a sum of card receiving spaces of the individual interlocked boards.

25. The game of claim 24, wherein the at least one graphic image includes at least one of an object, a character, a place, and an action.

26. The game of claim 24, wherein at least some of the playing cards include play indicia of different types, and each type of indicium appears on one or more of the at least some of the playing cards.

27. The game of claim 26, wherein the play indicia include at least one of colors, alphanumeric characters, geometric shapes, and symbols.

28. The game of claim 24, wherein at least some of the game boards include a first end portion and a second end portion, the first end portion includes at least one of a receiving portion and a protruding portion.

29. The game of claim 28, wherein the second end portion includes at least one of a protruding portion and a receiving portion.

* * * * *